United States Patent [19]

Mitchell et al.

[11] 4,018,434

[45] Apr. 19, 1977

[54] PNEUMATIC FEED DEVICE

[75] Inventors: Thomas J. Mitchell, Darien; Leonard M. Pengue, Huntington, both of Conn.

[73] Assignee: Pitney-Bowes, Inc., Stamford, Conn.

[22] Filed: Apr. 12, 1976

[21] Appl. No.: 675,907

[52] U.S. Cl. ..... 271/96; 271/122

[51] Int. Cl.[2] ..... B65H 3/12

[58] Field of Search ..... 271/94, 96, 95, 34, 271/35, 12, 122, 125, 11; 214/8.5 D, 8.5 G

[56] References Cited

UNITED STATES PATENTS

| | | | |
|---|---|---|---|
| 3,103,355 | 9/1963 | Hubbard et al. | 271/34 X |
| 3,504,909 | 4/1970 | Burkhardt | 271/96 X |
| 3,599,967 | 8/1971 | Rapparlie et al. | 271/94 X |
| 3,773,317 | 11/1973 | Kummerer | 271/122 X |
| 3,847,383 | 11/1974 | Wojtowicz et al. | 271/34 X |

*Primary Examiner*—Evon C. Blunk
*Assistant Examiner*—Bruce H. Stoner, Jr.
*Attorney, Agent, or Firm*—Albert W. Scribner; William D. Soltow, Jr.; Martin D. Wittstein

[57] ABSTRACT

An endless conveyor belt having a series of perforations is positioned between a vacuum outlet and a carrier having a stack of substantially flat documents. The vacuum is operated only when the perforations in the belt are positioned in front of the vacuum outlet to reduce drag on the belt. When the vacuum is operational, the belt will attract one of the documents from the stack and deliver it to a subsequent processing station. Means are provided for maintaining the documents in spaced relation from the belt when the vacuum is inoperative to preclude premature removal of a document from the stack by frictional contact of the document and the belt. A deflectable roller is also located adjacent the belt which rotates counter to the direction of travel of the belt to preclude the feeding of more than one document at a time by the belt to the subsequent processing station.

19 Claims, 7 Drawing Figures

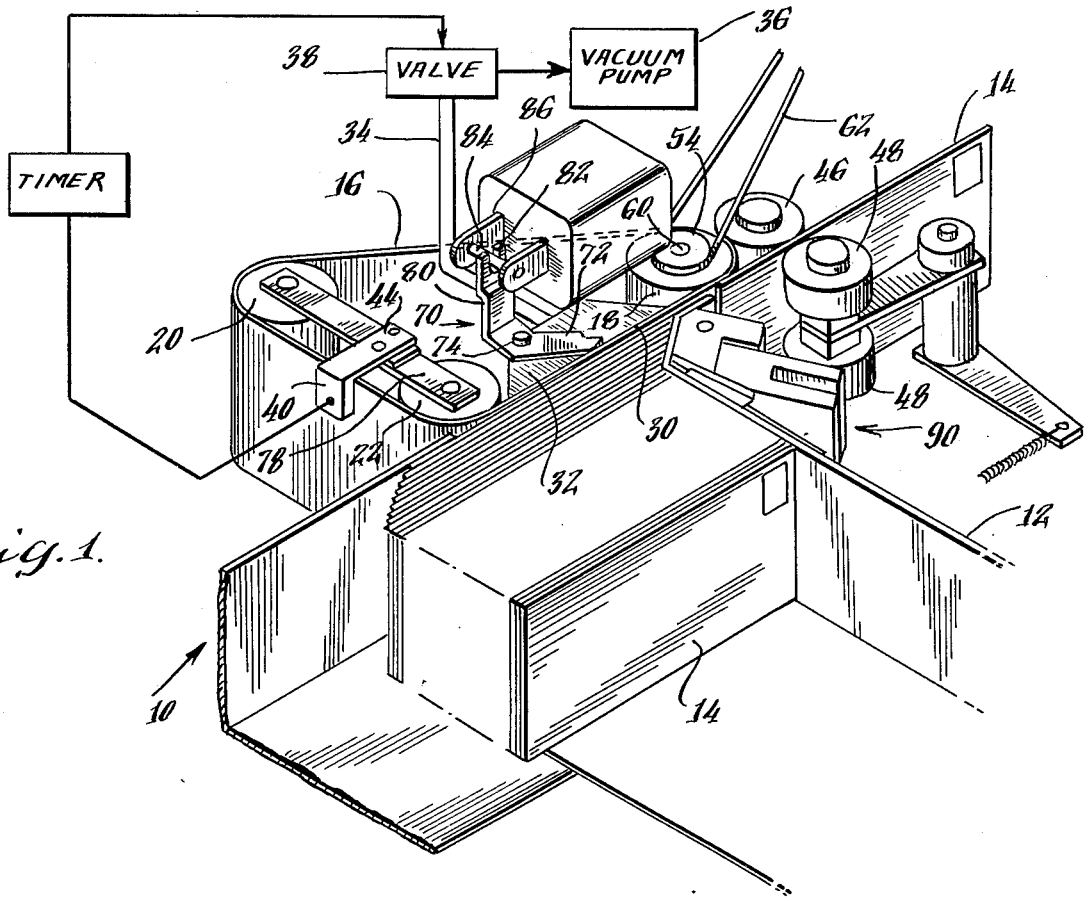
Fig. 1.
Fig. 6.
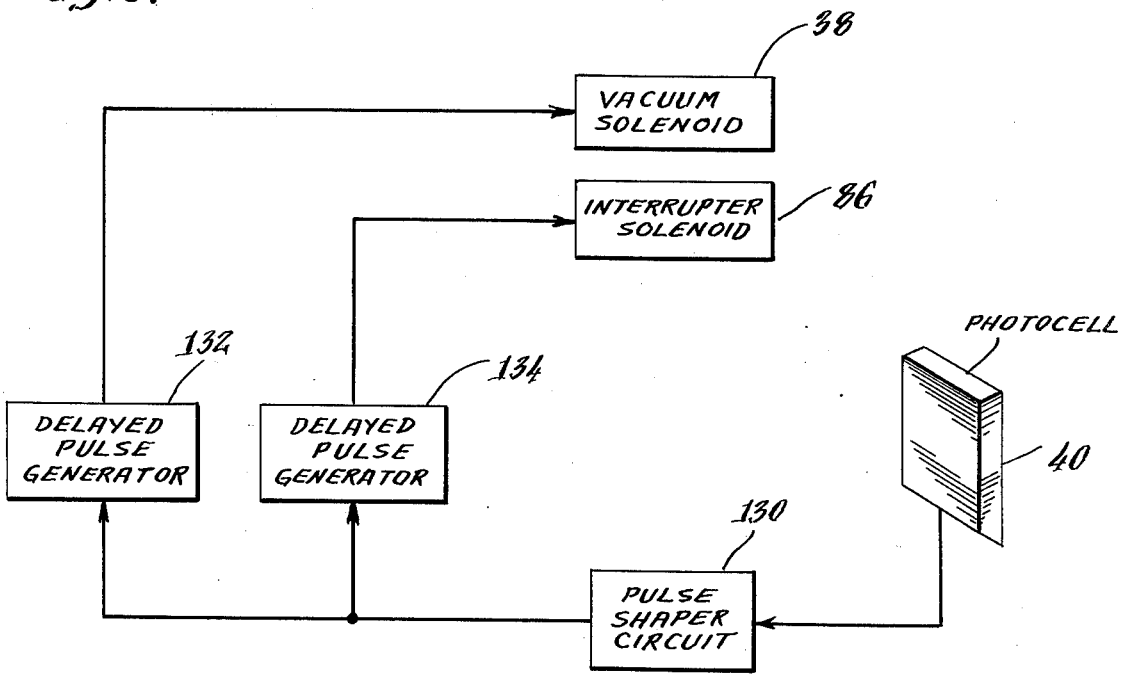

PNEUMATIC FEED DEVICE

FIELD OF THE INVENTION

This invention relates to a material handling device, and more particularly, a device for separating and feeding substantially flat articles of paper, cardboard, or the like, which have been assembled in a stack or a pile to a subsequent processing station. It is particularly applicable to the conveyance and processing of letters and other pieces of mail.

DESCRIPTION OF THE PRIOR ART

It is well known in the prior art to use pneumatic devices for removing the uppermost document from a stack or pile of documents. The pneumatic devices are usually in the form of a perforated tape or belt which is moved over the outlet of a suction nozzle. Individual documents which are to be separated and fed are subjected to the vacuum in the nozzle through the perforated tape or belt and are adhered to the same, which conveys the document to a subsequent processing station.

A number of problems have evolved in the use of such prior art separating and feeding devices.

First, since the belt or tape moves in front of the vacuum nozzle, which is actuated for continuous operation, a substantial amount of drag occurs between the tape or belt and the vacuum nozzle which impedes the rate of travel of the tape or belt. In many instances, the belt or tape adheres to the suction nozzle and the documents being fed by the device jam in the device. At the very least, the drag on the belt is increased many fold which often results in the belt or tape tearing or breaking.

Secondly, such prior art devices have suffered from so-called "double removal" of documents from the stack or pile, that is, the simultaneous removal of two or more adjacent documents. This is usually due to the first document frictionally dragging the second document stacked behind it along the belt or tape as the first document is separated and fed for subsequent processing.

The individual separation of documents, such as letters which are to be further processed in automatic letter sorting apparatus must be carried out with precision, since the faulty separation of letters would immediately result in a missorting. Accordingly, such material handling devices must have a very high separation speed and a very high reliability against "double removal."

SUMMARY OF THE INVENTION

In order to achieve the desired level of performance the present invention provides a document separator and feeder comprising a letter stack support that is adapted to advance a stack of letters towards a separator-feed belt that is entrained about three vertical drive rollers. The belt is formed with a plurality of vertically aligned holes in a pair of columns that are adapted to register with and pass in front of slots formed in the flat face of a vacuum shoe. The shoe is coupled by a hose to a vacuum source through a solenoid-operated valve.

A photocell detector cyclically senses the passage thereby of the belt holes, and controls the solenoid valve through an electronic timing circuit so that the vacuum supply is operational only when the belt holes move in front of the shoe. When operational, the shoe attracts and separates a letter from the stack to the belt, and the belt feeds the letter to a subsequent processing station. When the holes pass the end of the vacuum shoe, the timing circuit closes the solenoid valve and the vacuum supply to the belt is shut down.

The turning on and off of the vacuum controlled by the photocell detector effective through the time delay circuitry, which is calibrated to the belt speed, materially reduces the friction drag on the belt while no letter is being fed.

In order to further reduce the possibility that a letter will adhere to the belt when the vacuum supply is turned off, an interuptor arm is pivoted forward towards the stack by a second solenoid activated out-of-phase with the vacuum solenoid to hold the stack of letters away from the belt when the vacuum supply to the belt is cut off. This solenoid releases the arm to allow the stack to move towards the belt when the vacuum shoe is once again activated.

The pneumatic separator and feed device also includes a device associated with the belt for assuring that only one letter at a time is fed by the belt to a pair of oppositely rotating take-away rollers which transport the letter to a subsequent processing station. This device includes a roller which is rotated in a counter-direction to the direction of travel of the belt to block the feeding of a second letter which may frictionally adhere to the letter being fed. The counter-rotating roller is reciprocally mounted against a substantially constant force coil spring to compensate for variations in the thickness of the letters being fed by the belt to the processing station. By virtue of the constant force applied to the letter being fed, this force can be chosen at a predetermined value which enables the letter to be fed to the take-away rollers without undue force on the letter and belt to create a drag on the belt which will impede its travel.

BRIEF DESCRIPTION OF THE DRAWINGS

Further objects and advantages of the invention will become apparent from the following description and claims, and from the accompanying drawings, wherein:

FIG. 1 is a diagrammatic perspective view of the pneumatic feeding and separator device comprising the subject of the present invention;

FIG. 6 is a schematic block diagram of the apparatus for sensing the location of the holes in the feeding belt and subsequently controlling the operation of the vacuum supply solenoid and interuptor solenoid forming a portion of the feeding and separating device illustrated in FIGS. 1 and 2.

DETAILED DESCRIPTION OF THE PREFERRED EMBODIMENT

Figure 2:
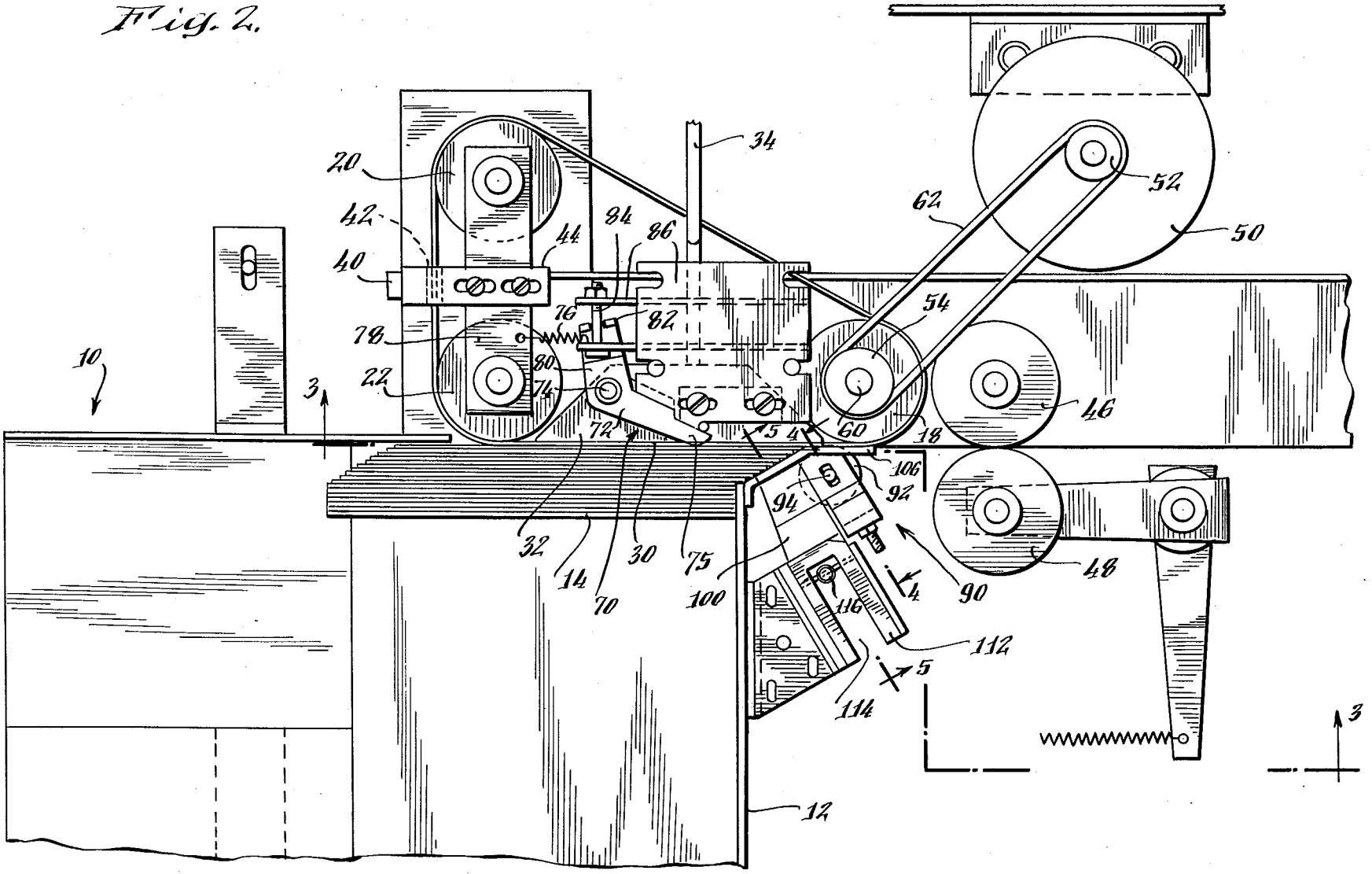
FIG. 2 is a top plan view of the pneumatic separator and feed device of the present invention.

Referring now to the drawings in detail, wherein like numerals indicate like elements throughout the several views, the pneumatic feed and separator device 10 of the present invention includes a document tray 12 which supports a plurality of documents such as letter envelopes 14 in a vertical position. Letters 14 are adapted to be advanced along tray 12 to a pneumatic feed belt 16.

Pneumatic feed belt 16 is a vertical, endless conveyor belt entrained about three rollers 18, 20 and 22 mounted on a stationary frame 24 supporting apparatus 10. Conveyor belt 16 is formed from low frictional material, except at a selected section 26 provided with a plurality of holes 28 therethrough arranged in two columns. Holes 26 are adapted to register with and pass in front of correspondingly elevated slots 29 in the flat face 30 of a vacuum shoe 32.

Rollers 18, 20 and 22 are rotatably driven by an electric motor 50 having a pulley 52 attached to the drive shaft thereof. Roller 18 has a pulley 54 attached to its mounting shaft 60. Pulley belt 62 is entrained about pulleys 52 and 54 so that rotational motion from motor 50 is imparted shaft 60 and roller 18 to rotate the roller to move endless conveyor belt 16 about rotatable rollers 20 and 22.

The vacuum shoe 32 is hollow and slotted and coupled by a hose 34 to a vacuum source 36, which may be a vacuum pump, through a solenoid-operated valve 38.

Solenoid valve 38 is operated cyclically by a photocell detector 40 which senses the passage of holes 28 in belt 16. As shown in FIG. 2, belt 16 passes through a slot 42 in a horizontal frame member 44 of device 10. Photocell detector 40 is mounted on the end of frame member 44.

In order to reduce the frictional drag on the belt 16 by vacuum shoe 32 while no letter 14 is being fed by the device 10, the vacuum supply 36 is only effectively connected to vacuum shoe 32 while the holes 28 in belt 16 pass in front of slots 29 in vacuum shoe 32 to attract and separate a letter 14 from the front of the stack on tray 12. The separated letter 14 is fed to the right as shown in FIGS. 1 and 2 by belt 16 between take-away rolls 46 and 48, which send the single letter 14 to a subsequent processing station. The turning on and off of the vacuum in shoe 32 is controlled by the detector 40 which is effective through time delay circuitry illustrated in FIGS. 6 and 7 to open solenoid valve 38 only while the belt holes 28 are in front of slots 29 in vacuum shoe 32.

Figure 7:
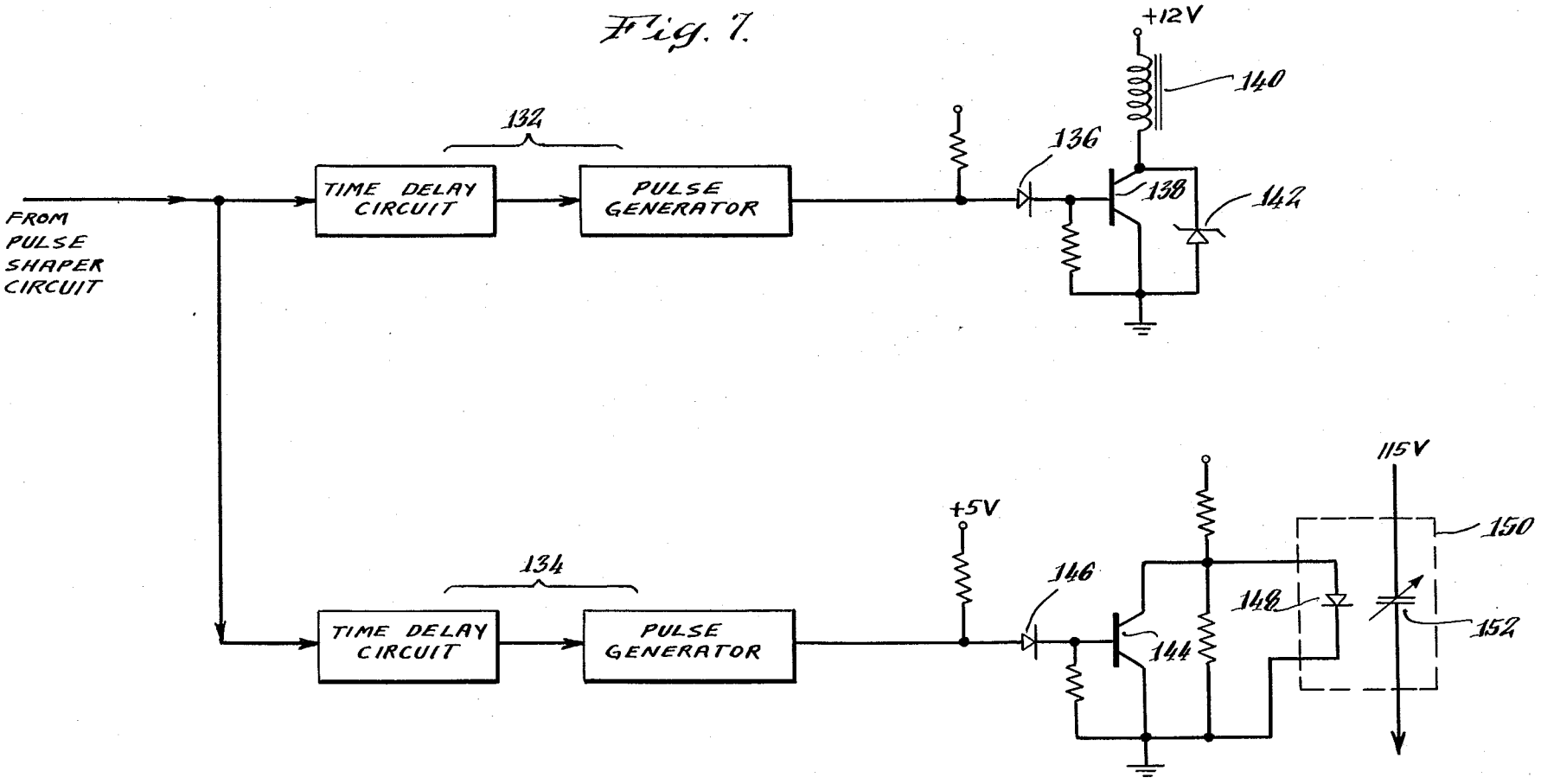
FIG. 7 is both a block and schematic electrical circuit diagram of some of the electrical components illustrated in the block diagram of FIG. 6.

The electronic circuitry required to open and close solenoid 38 is shown in block diagram form in FIG. 6 and in greater detail in FIG. 7. Referring first to FIG. 6, the timing cycle begins when one of the holes in belt 16 passes the photocell in the photocell detector 40. Light impinging on this photocell causes a generated pulse which is shaped in a conventional pulse shaper circuit 130. The shaped pulse is applied to delayed pulse generator circuits 132 and 134. Pulse generator circuit 132 has a separate output to vacuum solenoid valve 38, while pulse generator circuit 134 has a separate output to an interrupter solenoid 86 whose function is described hereinafter. Both of the delayed pulse generators 132 and 134 serve the same function; that is, to delay operation of the solenoids 38 and 86 until the leading line of holes is at the left edge of vacuum shoe 32. At the end of the delay period, vacuum solenoid 38 is energized to permit vacuum pump 36 to apply a vacuum at the vacuum shoe 32. At the same time, interrupter solenoid 86 is de-energized.

Referring to FIG. 7, it can be seen both delayed pulse generators 132 and 134 comprise a time delay circuit connected in series with a pulse generator. These elements may be conventional elements such as a 555 timer circuit available from Signetics Corporation of Menlo Park, California. The output of delayed pulse generator 132 is applied through a diode 136 to the base terminal of a NPN transistor 138 having its collector terminal connected through a solenoid coil 140 to a 12 volt source and to ground through a zener diode 142. When a positive going signal is applied to the base terminal of transistor 138, the transistor is driven to a conductive state establishing a current through solenoid coil 140. When energized, the solenoid valve 38 associated with the coil 140 establishes communication between vacuum shoe 32 and vacuum pump 36.

Mounted above vacuum shoe 32 is a document feed interruptor assembly generally designated by the numeral 70. Interruptor assembly 70 is used to space the stack of letters 14 in tray 12 from endless belt 16 when belt 16 is not in its feed mode so that the letters 14 are not frictionally fed accidentally to the take-away rolls 46 and 48.

Interruptor assembly 70 includes a lever arm 72 which is pivotally attached by a pin 74 to the top of vacuum shoe 32. Lever arm 72 includes a finger 75 adapted to be projected outwardly into the path of the stacked letters 14 in tray 12 to prevent them from coming into contact with endless conveyor belt 16. Normally, a coil spring 76 attached to horizontal frame number 78 of apparatus 10 and rear arm 80 of lever 72 keeps lever 72 and finger 75 in a retracted position relative to the stack of envelopes 14.

However, the rear of arm 80 of lever 72 includes an upright lug 82 mounting a bolt 84 therethrough. Opposite ends of the bolt 84 are connected to the plunger of an interrupter solenoid 86.

When vacuum solenoid 38 is inactive, interrupter solenoid 86 is activated to retract its plunger to cause lever 72 to pivot about pin 74 and project finger 75 into the path of feed movement of the stacked letters 14 in tray 12. Upon activation of solenoid 38, interruptor solenoid 86 is deactivated causing the return of finger 75, under the urging of spring 76, permitting the feed of letters 14 towards belt 16 and vacuum shoe 32.

As shown in FIG. 7, the output of delayed pulse generator 134 is applied to the base of any NPN transistor 144 through another diode 146. Transistor 144 is connected in parallel with a diode component 148 in a solid state relay 150. When transistor 144 is in its non-conductive state, current in the system is directed primarily through diode 148. The established current through the diode maintains solenoid 86 connected in series with contacts 152 in an energized state. However, when transistor 144 is driven into its conductive state by the output of delayed pulse generator 134, the transistor effectively short circuits diode 148 causing the contacts 152 to open, thereby de-energizing the serially-connected solenoid 86. When this occurs, lever 72 is pivoted out of contact with the letters 14 by coil spring 76 as long as the solenoid 86 remains de-energized.

A device generally indicated by the numeral 90 is used in conjunction with belt 16 to preclude more than one letter 14 from being fed by belt 16 to take-away rolls 46 and 48. The device 90 includes a roller 92 fixed to a shaft 94 mounted in suitable bearings 96 and 98 on frame members 100 and 102. A motor 104 drives roller 92 on shaft 94 via a universal coupling in a counter-direction to the direction in which the letters 14 are fed by belt 16 to rollers 46 and 48. Roller 92 extends through a guide member 106 to present a surface between guide member 106 and belt 16.

Figures 3, 4, 5:
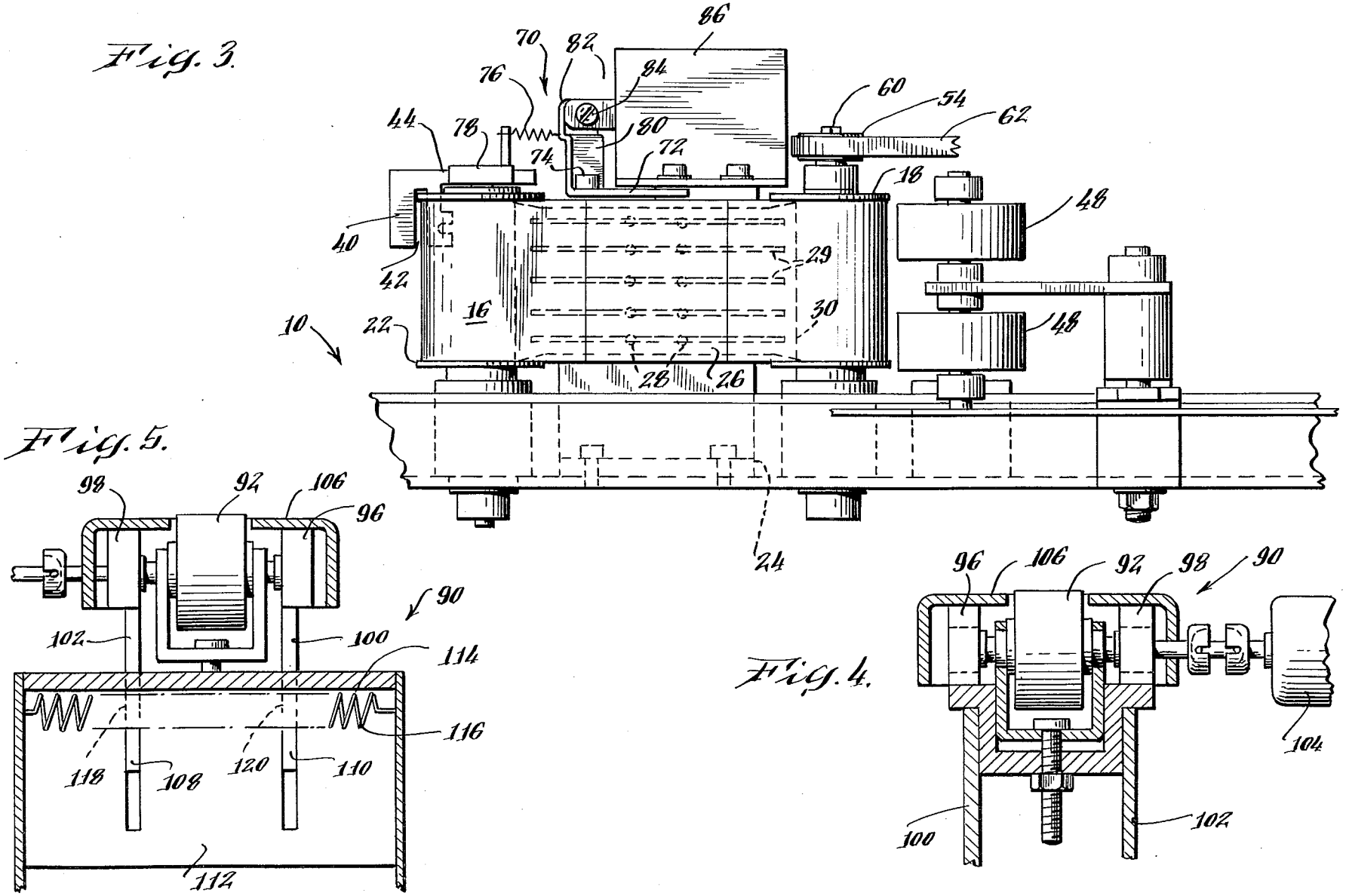
FIG. 3 is a front view in elevation of the pneumatic feed and separator device of FIG. 2, taken substantially along the plane indicated by line 3—3 of FIG. 2.
FIG. 4 is a cross-sectional view taken substantially along the plane indicated by line 4—4 of FIG. 2, illustrating a portion of the device used to assure that only one document at a time is fed by the feed belt for subsequent processing.
FIG. 5 is a cross-sectional view taken substantially along the plane indicated by line 5—5 of FIG. 2, and illustrating another portion of the device.

As shown in FIG. 5, frame members 100 and 102 are reciprocally slidable in slots 108 and 110, respectively, of a channel-shaped member 112 attached to one side of stacker tray 12. Channel-shaped member 112 includes an elongated slot 114 in which a coil spring 116 is positioned. Coil spring 116 extends through openings 118 and 120 in the frame members 102 and 100 respectively, and has its remote ends fixed.

Roller 92 extends into the space between guide 106 and belt 16 to prevent more than one letter 14 from being fed to take-away rolls 46 and 48. Should more than one letter be fed, the counter-rotating roller 92 will block the entry of all improperly fed letters between roller 92 and the properly fed letter 14 which is the letter against the belt 16. Because of the lateral mounting of spring 116 in contact with frame members 100 and 102, roller 92 and its mounting assembly can be deflected to allow for variations in thickness of the fed letters. Roller 92 will be deflected uniformly against the bias of lateral spring 116, which will exert a substantially constant force on the roller 92 regardless of its thickness of succeeding letters 14 so that roller 92 will not bind or jam the letters against belt 16.

What is claimed is:

1. Apparatus for separating substantially flat articles from a stack and for feeding them individually to another position comprising:

a conveyor member having a number of perforations along a fixed length thereof, means for driving said conveyor member, a carrier for a stack of articles disposed adjacent one side of said conveyor member, vacuum shoe means adapted to be connected to a source of vacuum having an outlet disposed adjacent the other side of said conveyor member opposite to said carrier, means for sensing the perforations in the fixed length of said conveyor member, and means responsive to the sensing of the perforations on said conveyor member by said sensing means for connecting said vacuum shoe means to said vacuum source for a predetermined time interval.

2. Apparatus in accordance with claim 1 wherein said time interval corresponds to the amount of time the perforations in said fixed length of said conveyor member are positioned in front of said vacuum shoe means.

3. Apparatus in accordance with claim 1 wherein said conveyor member is a vertical, endless belt.

4. Apparatus in accordance with claim 1 wherein said sensing means is a photocell.

5. Apparatus in accordance with claim 1 wherein said connecting means is a solenoid valve.

6. Apparatus in accordance with claim 5 wherein said solenoid valve is located between said vacuum shoe means and said vacuum source, the coil of said solenoid valve being connected to said sensing means by a time delay electric circuit.

7. Apparatus in accordance with claim 1 further including means between said conveyor member and carrier for retaining said stack of articles in spaced relation to said conveyor member when said vacuum shoe means is not connected to said vacuum source.

8. Apparatus in accordance with claim 7 wherein said retaining means includes a pivoted arm mounted on said vacuum shoe means.

9. Apparatus in accordance with claim 8 wherein said retaining means includes a solenoid connected to said arm for pivoting said arm on said vacuum shoe means.

10. Apparatus in accordance with claim 9 wherein the coil of said solenoid is connected to said sensing means by a time delay electric circuit.

11. Apparatus in accordance with claim 1 further including means adjacent to said conveyor member for preventing more than one of said articles in said stack from being fed to another position by said conveyor member when the perforations in said conveyor member are in front of said vacuum shoe means.

12. Apparatus in accordance with claim 11 wherein said means includes a roller mounted on said one side of said conveyor member rotatable in a direction opposite to the direction of travel of said conveyor member.

13. Apparatus in accordance with claim 12 wherein said roller is deflectably mounted towards and away from said conveyor member.

14. Apparatus in accordance with claim 13 wherein said roller is deflectably mounted against the bias of a spring.

15. Apparatus in accordance with claim 14 wherein said spring is a coil spring connected intermediate its ends to said roller mounting, and said coil spring extending in a direction substantially parallel to the roller axis.

16. Apparatus in accordance with claim 11 further including means between said conveyor member and carrier for retaining said stack of articles in spaced relation to said conveyor member when said vacuum shoe means is not connected to said vacuum source.

17. Apparatus in accordance with claim 13 further including means between said conveyor member and carrier for retaining said stack of articles in spaced relation to said conveyor member when said vacuum shoe means is not connected to said vacuum source.

18. Apparatus in accordance with claim 17 wherein said retaining means includes a pivoted arm mounted on said vacuum shoe means.

19. Apparatus in accordance with claim 18 wherein said retaining means includes a solenoid connected to said arm for pivoting said arm on said vacuum shoe means.

* * * * *